US005971069A

United States Patent [19]

Stoy et al.

[11] Patent Number: 5,971,069

[45] Date of Patent: Oct. 26, 1999

[54] WELL COMPLETION AND PRODUCTION TECHNIQUES

[75] Inventors: James R. Stoy, Javarta, Indonesia; Kevin R. Bowlin, Sugar Land, Tex.

[73] Assignee: Texaco Inc., White Plains, N.Y.

[21] Appl. No.: 08/908,890

[22] Filed: Aug. 8, 1997

[51] Int. Cl.[6] ..... E21B 47/00

[52] U.S. Cl. ..... 166/250.03; 166/250.15; 166/370; 166/372

[58] Field of Search ..... 166/250.03, 250.15, 166/369, 370, 372, 373

[56] References Cited

U.S. PATENT DOCUMENTS

| | | | |
|---|---|---|---|
| 4,040,483 | 8/1977 | Offeringa | 166/401 |
| 4,042,029 | 8/1977 | Offeringa | 166/305.1 X |
| 5,314,017 | 5/1994 | Schechter et al. | 166/252.3 |
| 5,476,145 | 12/1995 | Sengul et al. | 166/305.1 X |
| 5,778,977 | 7/1998 | Bowzer et al. | 166/252.1 |

*Primary Examiner*—Roger Schoeppel
*Attorney, Agent, or Firm*—Henry H. Gibson; William J. Beard

[57] ABSTRACT

Methods for completing and producing hydrocarbon from a well having a highly permeable production formation having a water zone and a hydrocarbon zone are disclosed. In the disclosed techniques a cased well borehole is cemented in place through the production formation. A packer is set in the casing to isolate the hydrocarbon zone from the water zone. Perforations in the water zone and in the hydrocarbon zone produce a mixture of both fluids into the casing/tubing annulus at different bottom hole pressures (FBHP's) due to the installation of a flow restriction limiting the flow of either hydrocarbon or water into the tubing string. Artificial lift means are used to produce the fluid mixture to the surface.

11 Claims, 5 Drawing Sheets

WELL COMPLETION AND PRODUCTION TECHNIQUES

FIELD OF THE INVENTION

This invention relates to methods and apparatus for producing hydrocarbon from boreholes drilled into earth formations. More particularly, the invention relates to techniques for well completion and production which employ the concept of reverse water coning in well boreholes to more efficiently produce hydrocarbons, and even more particularly, to such techniques employing in-situ gravity segregation (IGS), and employing only a single fluid conduit to conduct produced well fluids to the surface.

BACKGROUND OF THE INVENTION

Many oil and gas wells in the past have suffered from the physical phenomenon known as "water coning". This phenomenon can seriously affect the rate of hydrocarbon production in a well, even to the point of rendering a perfectly good well non-commercial to produce because of massive water cut or water to oil ratio in the produced well fluid. In water coning, there is a hydrocarbon bearing formation (oil or gas or both) without an impermeable barrier or layer of earth formation between the water and oil bearing layers. That is to say, there is an oil/water contact surface in the well. This situation is common even in the most prolific producing formations wherein an underlying "water drive" can be a main pressure source for hydrocarbon production. When hydrocarbon is withdrawn from the formation by perforations above the oil/water conduct the underlying water is drawn up into the void pore spaces by the viscous forces acting on the fluid. Water thus invades the hydrocarbon bearing portion of the formation, and can do this even up to and beyond level of the production perforations. This can severely impede the rate at which the hydrocarbon can thereafter be withdrawn from the production perforations. The local rise (near the perforations) in the oil/water contact surface has a conical shape, being highest near the borehole and tapering off away from the borehole, thus leading to the name "water coning".

In the prior art, it has been proposed to complete such a well so as to mitigate the effect of water coning by producing into the wellbore, a significant volume of water, drawn thereto by a second set of perforations in the well casing and located below the oil/water contact surface while concurrently producing hydrocarbon through perforations in the well casing above the oil/water contact surface. The water production below the oil/water contact surface has the effect of suppressing the creation of the water cone. This protects the hydrocarbon zone near the casing from being invaded by the underlying water. The downward viscous forces imposed on the formation fluid created by withdrawing water below the oil/water contact surface tend to balance the upward viscous forces created by withdrawing hydrocarbon from the formation above the oil/water contact surface. Hydrocarbons may therefore be withdrawn from the formation through the hydrocarbon production perforations at rates significantly greater than is possible under conditions where a water cone has invaded the hydrocarbon bearing formation. This technique has come to be known in the art as In-Situ Gravity Segregation or IGS.

The present invention, however, provides methods for well completion and production allowing the IGS technique to be practiced using a single string of production tubing and conventional artificial lifting technique. Also, using the techniques to the present invention it is possible to produce and induce different $FBHP_{(oil)}$ and $FBHP_{(water)}$ pressures and lift to the surface fluids from two perforated intervals having different bottom hole flowing pressure (BHFP's) while using only a single fluid conduit to the surface. This may be accomplished whether or not the upper set of perforations' BHFP is greater or less than the lower perforations' BHFP.

BRIEF DESCRIPTION OF THE INVENTION

Briefly the present invention comprises methods of well completion and production which employ the IGS technology and artificial lift while employing only a single production tubing string to the surface for both produced fluids. The well is cased and perforated above the oil/water contact and below the oil/water contact surfaces. The hydrocarbon zone is sealed internally in the well bore by packers or seals set above the production perforations and also below the oil/water contact surface. The packers or seals are penetrated by a single production tubing string having its lower end in the water zone and having tubing ports in the oil zone so that produced fluids from both zones may enter it. Artificial lifting apparatus such as ESP's, PCP's or gas lift valves are installed in the tubing string above the upper packer.

In the case where the FBHP requirement to prevent water coning is greater in the water zone, an orifice or choke, is employed in the tubing string penetrating into that zone to restrict water flow into the tubing. This increases the FBHP in the water zone. In the case where the FBHP must be greater in the hydrocarbon zone to prevent water coning, an orifice or choke is employed in the tubing ports entering from the hydrocarbon zone to restrict hydrocarbon flow into the tubing. This causes the FBHP in the hydrocarbon or oil zone to increase. The choke restrictions are chosen to give appropriate fluid flow from either zone to cause the IGS technique. Produced fluid entering the single tubing string in the desired preselected ratio is then conducted to the surface using artificial lifting means such as gas lift, ESP, PCP or rod pumps.

The invention may best be understood by reference to the following detailed description thereof, when taken in conjunction with the accompanying drawings.

DETAILED DESCRIPTION OF THE INVENTION

Figure 1:
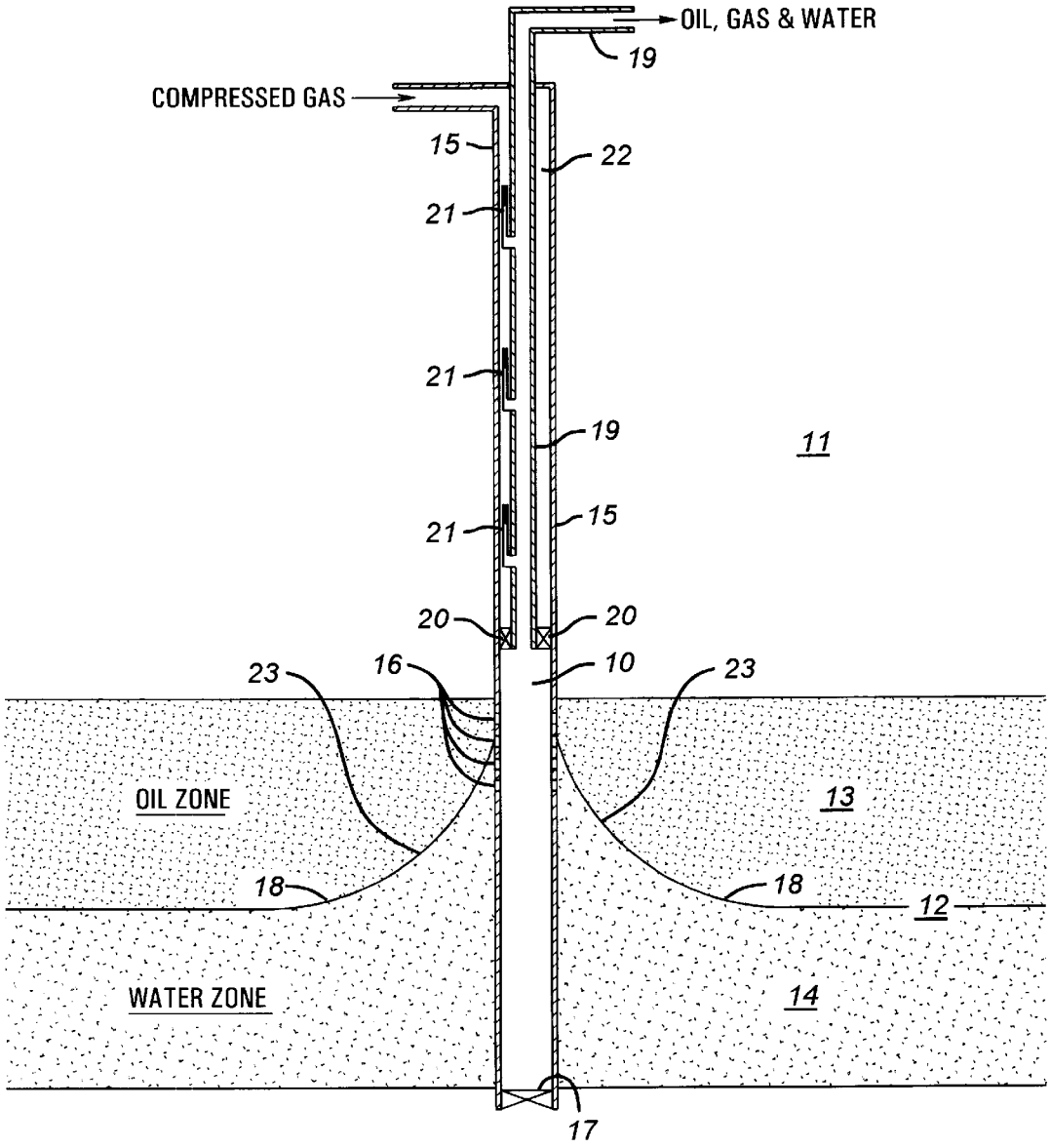
FIG. 1 is a schematic diagram of a producing well showing the effect of water coning is a well on gas lift.

Referring initially to FIG. 1, a schematic drawing of a well lifting produced fluid on gas lift and being affected by the phenomenon of "water coning" is illustrated. A well borehole 10 penetrates earth formations 11 and 12 with formation 12 being a highly permeable formation having a hydrocarbon zone 13 and a water zone 14. The borehole 10 is lined with a steel casing 15 terminated in a plug 17 below the producing zone 12 and having a set of perforations 16 therein which initially was placed above the oil/water contact surface 18 but which, as shown, has been affected by water coning. A production tubing string 19 extends from a packer 20 to the surface and is equipped with a plurality of gas lift valves 21. In gas lift, a source of compressed natural gas (not shown) introduces natural gas under pressure into the casing/tubing annulus 22 as shown. Gas lift valve 21 permits one way flow of the pressurized gas into the tubing string 19 where it interacts with fluids produced from the formation 12 into the borehole 10 via perforations 16. The compressed gas lightens the produced fluids stream reducing the density from that of the produced fluid. The formation pressure, normally not enough to lift the produced fluid to the surface, is able to lift the lighter fluid column to the surface because of its reduced density. At the surface, separators may separate the produced oil and water and recycle the produced gas.

In the well shown in FIG. 1 the hydrocarbon zone 13 has been produced at such a rate that viscous forces have acted on the oil/water contact surface 18, particularly in the volume of the formation 12 near the borehole 10. The oil/water contact surface 18 has been drawn upward by the viscous forces in the formation acting on it. This has formed the inverted cone shaped volume 23 or water cone. The water cone 23 has impinged on the perforations 16 producing an undesired water cut and seriously affecting the rate at which hydrocarbon can be withdrawn from the hydrocarbon zone 13.

Figure 2:
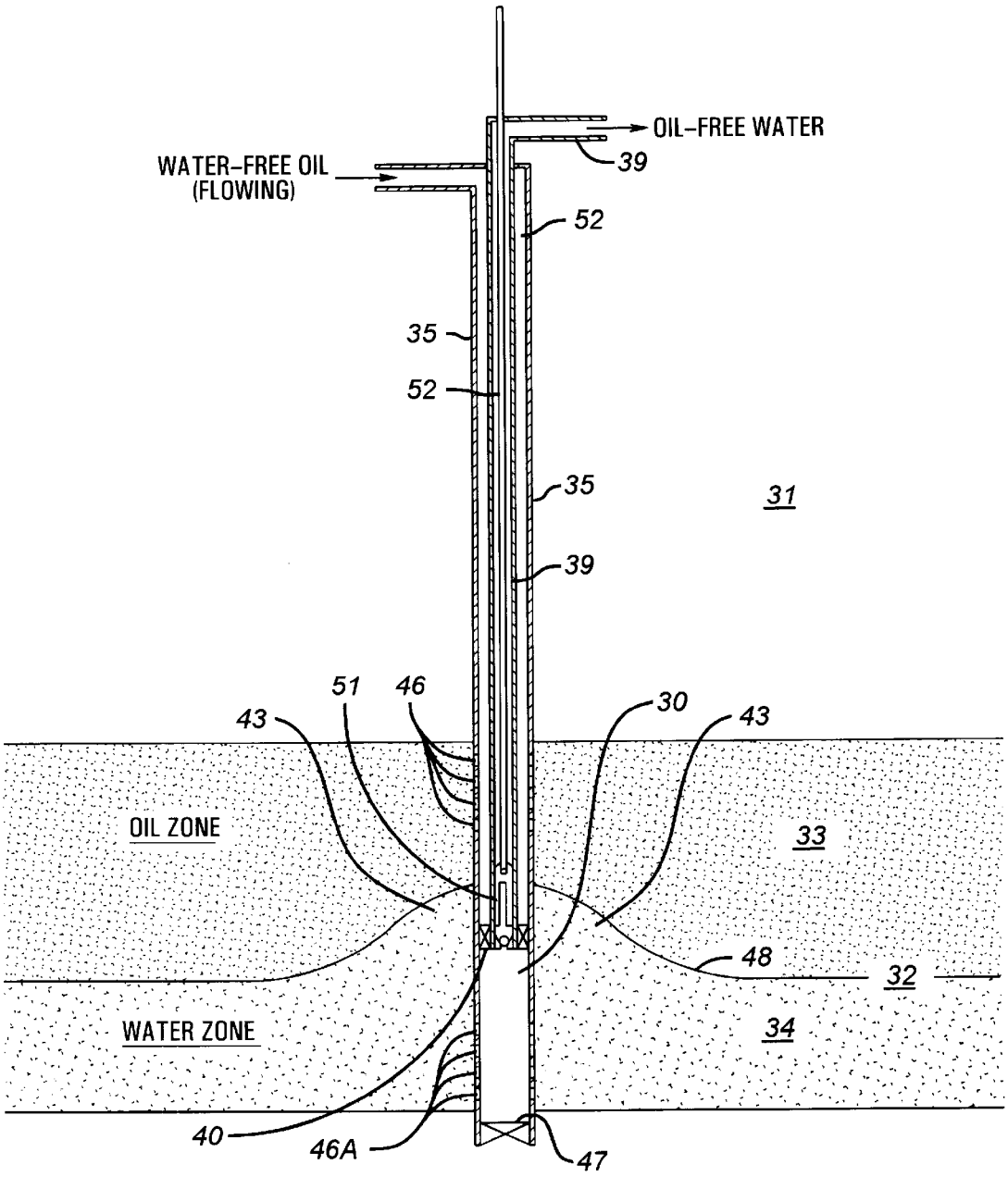
FIG. 2 is a schematic diagram of a producing well applying the IGS technique using a rod pump to move water and flowing hydrocarbon into the annulus.

To alleviate the problem of water coning the technique of In-Situ Gravity Segregation or IGS is illustrated in FIG. 2. In FIG. 2 the well borehole 30 penetrates earth formations 31 and 32. Formation 32 is a highly permeable formation having a hydrocarbon zone 33 and a water bearing zone 34 therein. A casing 35 is set and terminated it plug 47 and is perforated at 46 in the hydrocarbon zone and at 46A in the water zone.

A sucker rod pump assembly 51 is installed in the lower end of production tubing string 39 which terminates in packer or seal 40 set below the oil/water contact surface 48. A sucker rod string 52 extends to the surface inside tubing 39 where it is driven up and down in a reciprocating manner by conventional surface means (not shown). In the well of FIG. 2 the hydrocarbon zone 33 has sufficient pressure to produce hydrocarbons via perforations 46 into the casing/tubing annulus 52 where they are conducted to the surface. Water is produced at a comparable rate through water zone perforations 46A and pumped to the surface by rod pump assembly 51 in tubing string 39. The concurrent, but separate, production of water and oil leads to the suppression of the water cone 43 in the borehole vicinity. The suppressed water cone 43 does not impinge on the hydrocarbon zone perforations 46 and this leads to an increased rate of hydrocarbon production.

The production/completion technique of FIG. 2 may be used if either the water zone or the oil zone, or both, have sufficient pressure to lift fluids to the surface. If either zone does not, then an artificial lift means as shown in FIG. 2 (rod pump) can be employed in the tubing string while the pressured zone is produced in the casing/tubing annulus. If both zones required artificial lifting means, however, a second tubing string (or dual action pumping system) would have to be employed within the casing 35. This might not be feasible with conventional sized casing.

Figure 3:
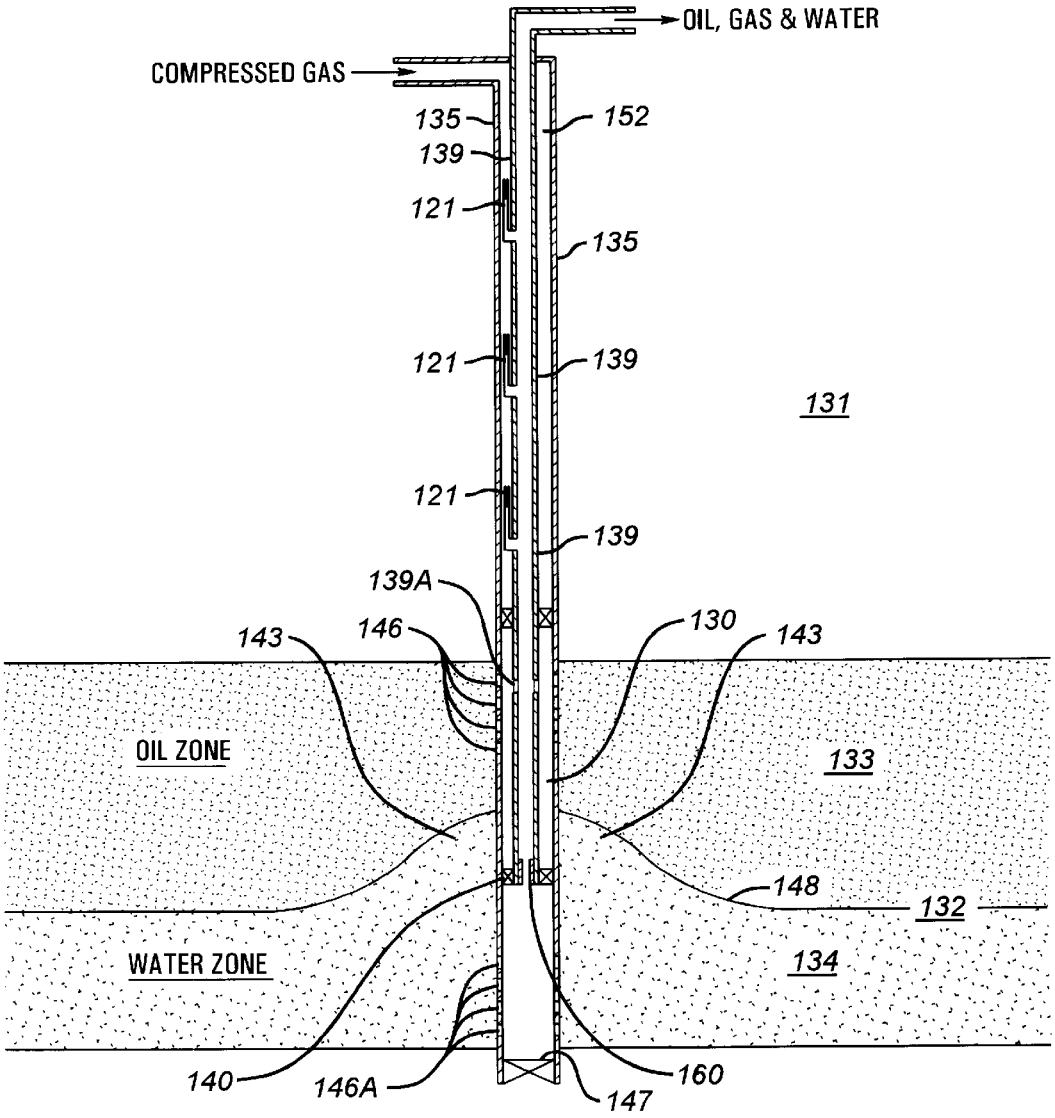
FIG. 3 is a schematic diagram of a producing well on gas lift showing the completion and production technique of the present invention applying the IGS technique where the water zone has a higher FBHP than the hydrocarbon zone.

In the completion/production system of FIG. 3, methods according to the present invention are employed in a well, employing the IGS technique and artificial lifting in both the water and hydrocarbon zones where the FBHP is higher in the water zone than in the hydrocarbon zone, and only one tubing string is required.

The well borehole 130 again penetrates earth formations 131 and 132. Formation 132 is a highly permeable formation having a hydrocarbon zone 133 and a water zone 134. In this well it has been determined that due to formation characteristics that the water zone 134 must be restricted causing a higher pressure in water zone 134 than in the hydrocarbon zone 133 to balance reservoir forces to prevent water coning. However neither zone has a sufficient pressure to lift fluids to the surface. Casing 135 lines borehole 130 and is provided with a set of perforations 146 in the hydrocarbon zone 133 and a second set of perforations 146A in the water zone 134. Casing 135 terminates in plug 147. The water zone 134 and hydrocarbon zone 133 are isolated interior to the casing via packers 140, the lower packer, and 151, the upper packer. A production tubing string 139 extends to the surface and is provided with gas lift valves 121, as an artificial lifting source. Other artificial lifts such as pumps could be used if desired. Tubing string 139 terminates at its lower end penetrating packer 140 with an orifice plate 160. The size of the orifice in orifice plate 160 causes there to be a higher $FBHP_{(water)}$ pressure in the water zone thus restricting flow of water. Tubing string 139 is also provided with one or more tubing ports 139A in the interval adjacent the lower FBHP pressure hydrocarbon zone 133 which is isolated between packers 140 and 151. Pressurized compressed natural gas is introduced into the casing/tubing annulus 152 from a surface source (not shown). Gas lift valves 121 permit the one way flow of the pressurized gas into the tubing string 139 where it permeates the tubing string and lowers the density of the oil/water mixture entering the tubing via ports 139A and orifice plate 160. The formation pressure inside the tubing string is sufficient to lift the lowered density oil/water/gas fluid to the surface inside the tubing string 139.

The constriction of orifice plate 160 is chosen based on the pressure differential desired to be induced between zones 133 and 134, the formation permeability, and the viscosity of the crude in oil zone 133 to allow water production into perforations 146A at a rate to suppress any excess water cone 143. The oil/water interface 148 is kept below upper perforations 146 during production by this method.

Figure 4:
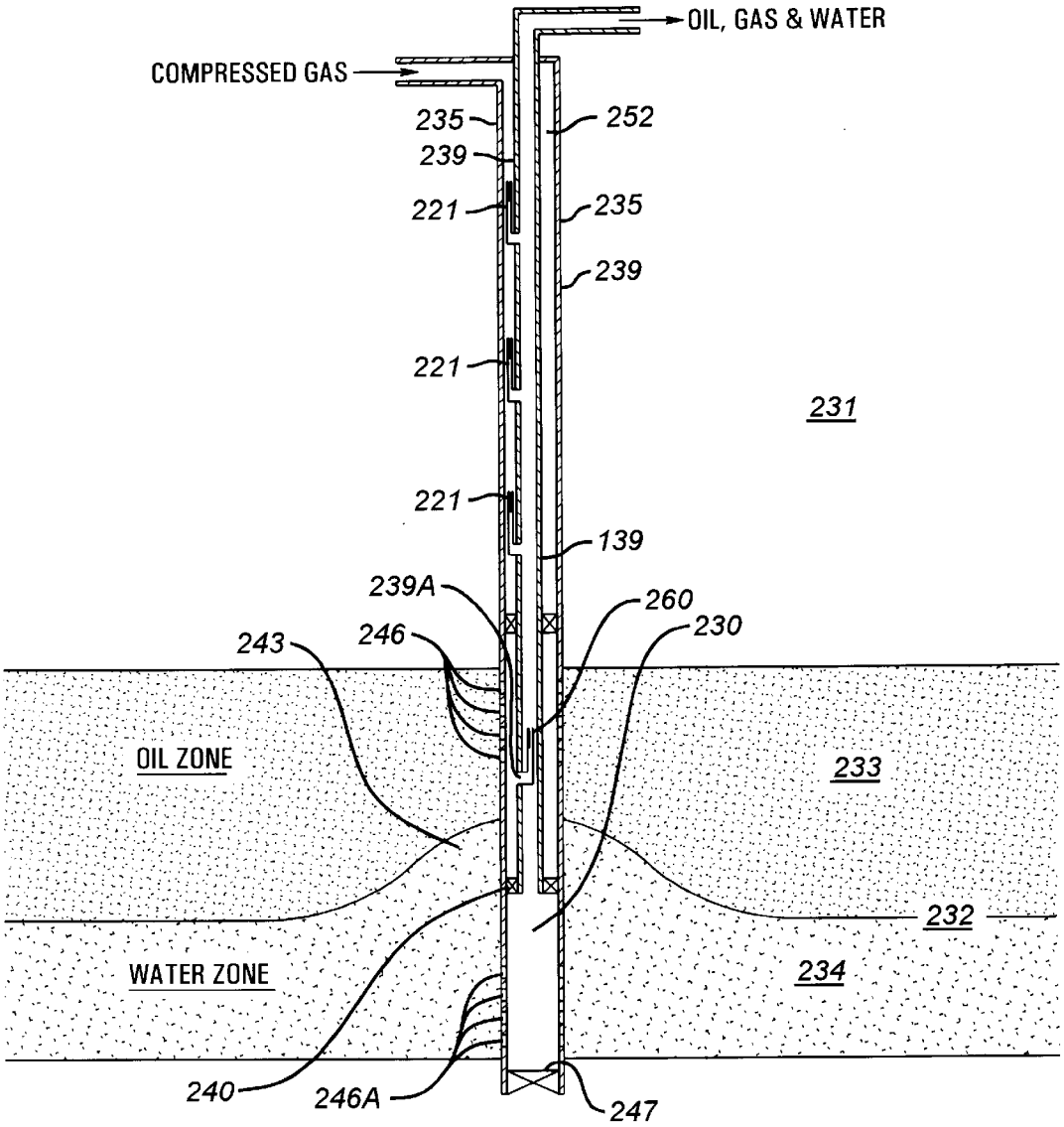
FIG. 4 is a schematic diagram of a producing well on gas lift showing the completion and production technique of the present invention applying the IGS technique where the hydrocarbon zone has a higher FBHP than the water zone. And, FIG. 5 is a schematic drawing showing a completion using a submersible electric pump to lift production fluids to the surface.

Referring now to FIG. 4, methods of well completion and production according to the concepts of the present invention and employing the IGS technique issued in production from a well requiring a higher pressure (FBHP) in oil zone 233 than in water zone 234 to suppress water coning, while using only one tubing string on artificial lift for both produced hydrocarbon and water.

Well borehole 230 penetrates earth formations 231 and 232. Formation 232 is again a highly permeable formation having a hydrocarbon zone 233 and a water zone 234. In the well of FIG. 4 it has been determined that if hydrocarbon zone 233 must be restricted resulting in a higher pressure than that of water zone 234 (but neither zone have sufficient pressure to lift produced fluids to the surface without artificial lifting being used) then excess water coning into perforations 246 will be avoided. The borehole 230 is lined with a steel casing 235 terminated at its lower end by plug 247. The casing 235 has two sets of perforations therein, an upper set 246 into the oil or hydrocarbon zone 233 of highly permeable formation 232, and a lower set 246A into the water zone 234. The oil zone 233 and the water zone are isolated interior to casing 235 by a lower packer 240 and an upper packer 251. A tubing string 239 penetrates both packers 240 and 251 and terminates at lower packer 240 providing fluid communication from oil zone perforations 246A to production tubing 239. A tubing port 239A provides fluid communication into tubing string 239, via an orifice 260, with perforations 246 in the higher pressure oil zone 233. Pressurized compressed natural gas is introduced from a surface supply (not shown) into the casing/tubing annulus 252 at the surface. The gas lift valves 221 permit one way flow of gas from the annulus 252 into the interior of the tubing string 239 where it can interact with produced fluids from perforations 246A and 246 to form a reduced density oil/water/gas fluid in the tubing 239. This lower density fluid is lifted to the surface by the formation pressure of the oil zone 253 and water zone 234 which is sufficient for this purpose.

The constriction of orifice 260 is chosen based on the desired pressure differential between zones 233 and 234 to suppress water coning the permeability of the formation 232 and the viscosity of the oil in zone 233. The back pressure in the hydrocarbon zone 273 which is induced by orifice 260 allows sufficient water production into perforations 246A at a rate to suppress the water cone 243, hence applying the IGS technique principle. The oil/water interface 248 is kept below upper hydrocarbon producing perforations 246 during production by this method.

Figure 5:
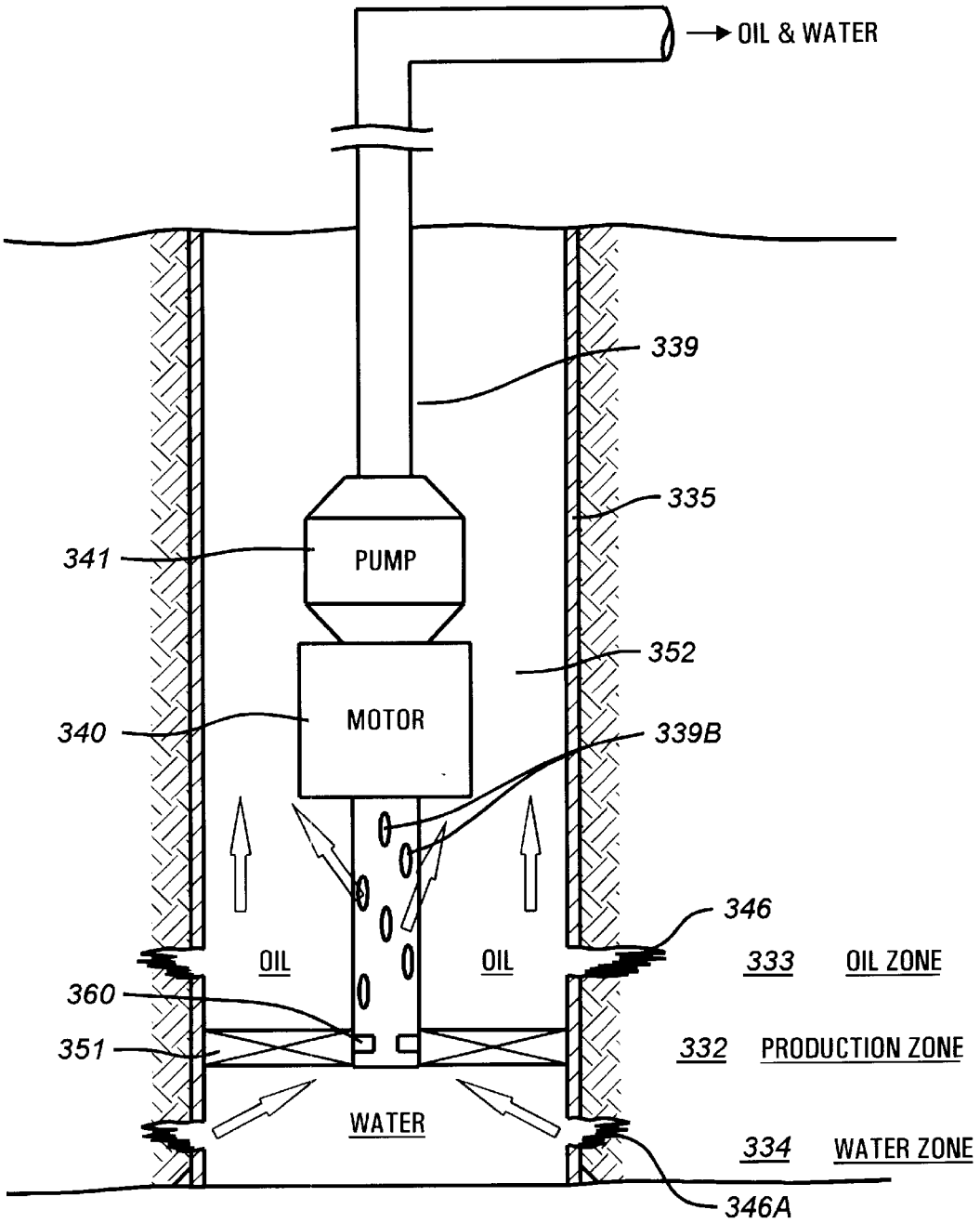

Referring now to FIG. 5 a well completion similar to that of FIG. 3 (higher desired FBHP in the water zone) is shown schematically. A well borehole 352 is cased with steel casing 335 and penetrates into a very permeable production interval 332 having an oil zone 333 and a water zone 334. In formation 332 it has been determined that it would be desirable to induce a higher FBHP in water zone 334 than in oil zone 333 to suppress water coning. The zones 333 and 334 are isolated interior to casing 335 by packer 351. The oil zone has perforation 346 and the water zone has perforation 346A. A tubing string 339 goes to the surface and has, near its lower end an electric pump comprising pump body 341 and motor 340. Fluid ports 339B above packer 351 draw in oil while water enters the lower end of tubing string 339 via a variable orifice 360. Variable orifice 360 may be of the type hydraulically or electrically controlled from the surface. The size of orifice 360 is adjusted and selected to provide the desired induced FBHP differential between the oil zone 333 and the water zone 334 to suppress the undesired water coning. Alternatively, a fixed size orifice could be used, if desired.

The foregoing descriptions may make other techniques and configurations apparent to those of skill in the art. For example, in each of the completions shown other artificial lifting techniques rather than gas lift or ESP's could be applied to lift the fluid in the tubing. The aim of the appended claims is to cover all such changes and modifications that fall within the true spirit and scope of the invention.

We claim:

1. A method of well completion and production in a well having a highly permeable production formation having a water zone and a hydrocarbon zone which employs the principle of in-situ gravity segregation and using artificial lifting means with only one tubing string where fluids must be produced from both of said zones by artificial lifting, comprising the steps of:

drilling a well borehole through earth formations and penetrating a permeable producing formation having a hydrocarbon/water contact surface or interface therein;

casing said well borehole with casing and perforating said casing in said producing zone in a first perforation set above said hydrocarbon/water interface and in a second perforation set below said hydrocarbon/water interface;

isolating, interior to said casing, said hydrocarbon zone and said water zone by setting an appropriate packer or seal in said casing;

installing a tubing string from the surface and penetrating said packer and having its interior in fluid communication with said upper and lower perforations, said tubing string having at least one tubing port along its length and an open lower end;

producing fluids from both sets of said perforations into said tubing string simultaneously, but at different flowing bottom hole pressures to create a produced fluid mixture therein; and artificially lifting said produced fluid mixture to the surface via said tubing string.

2. The method of claim 1 wherein said hydrocarbon zone needs to be restricted based on rock and field properties to have a higher Flowing Bottom Hale Pressure$_{(oil)}$ than said water zone and a fluid flow restriction is placed in said tubing port to reduce hydrocarbon flow thereby inducing said higher Flowing Bottom Hale Pressure$_{(oil)}$.

3. The method of claim 2 wherein said fluid flow restriction comprises an orifice whose size is determined based on allowing sufficient relative volume flow rates of hydrocarbon and water to be produced to prevent said hydrocarbon/water interface from rising to the level of the upper perforations.

4. The method of claim 3 wherein the determination of the size of said orifice is based on the desired pressure differential between said hydrocarbon and said water zones.

5. The method of claim 4 wherein the determination of the size of said orifice is based on the permeability of said formation also.

6. The method of claim 5 wherein the determination of the size of said orifice is based on the viscosity of the hydrocarbon in said hydrocarbon zone also.

7. The method of claim 1 wherein said water zone needs to be restricted based on rock and field properties to have a higher Flowing Bottom Hale Pressure$_{(water)}$ than said hydrocarbon zone and a fluid flow restriction is placed in said open lower end of said tubing string to reduce water flow thereby inducing said higher Flowing Bottom Hale Pressure$_{(water)}$.

8. The method of claim 7 wherein said fluid flow restriction comprises an orifice whose size is determined based on allowing only sufficient hydrocarbon and water to be produced to prevent said hydrocarbon/water interface from rising to the level of the upper perforations.

9. The method of claim 8 wherein the determination of the size of said orifice is based on the desired pressure differential between said hydrocarbon and said water zones.

10. The method of claim 9 wherein the determination of the size of said orifice is based on the permeability of said formation also.

11. The method of claim 10 wherein the determination of the size of said orifice is based on the viscosity of the hydrocarbon in said hydrocarbon zone also.

* * * * *